US005400722A

United States Patent [19]

Moses et al.

[11] Patent Number: 5,400,722

[45] Date of Patent: Mar. 28, 1995

[54] SECURITY MODULE

[75] Inventors: Leonard C. Moses, Tunnel Hill, Ga.; John H. W. Kendall, Chattanooga; Bradley G. Hyde, Collegedale, both of Tenn.

[73] Assignee: American Engineering Corporation, Ooltewah, Tenn.

[21] Appl. No.: 981,823

[22] Filed: Nov. 25, 1992

[51] Int. Cl.[6] ..... E04H 9/00

[52] U.S. Cl. ..... 109/2; 109/7; 109/9; 109/21; 109/87; 70/278

[58] Field of Search ..... 70/278; 109/2, 3, 5–10, 109/18, 21, 22, 23, 31, 38, 58, 62, 63, 78, 87

[56] References Cited

U.S. PATENT DOCUMENTS

| | | | |
|---|---|---|---|
| 1,915,735 | 6/1933 | Helms | 109/7 |
| 3,286,664 | 11/1966 | Fulks | 109/7 |
| 3,750,158 | 7/1973 | Anastassakis | 109/7 X |
| 3,844,232 | 10/1974 | Robinson | 109/7 |
| 3,990,069 | 11/1976 | Schuman | 109/38 X |
| 4,122,783 | 10/1978 | Pretini | 109/3 |
| 4,481,887 | 11/1984 | Urbano | 109/3 |
| 4,586,441 | 5/1986 | Zekich | 109/6 X |
| 4,741,275 | 5/1988 | Lewiner et al. | 109/7 |
| 4,947,765 | 8/1990 | Bledess | 109/6 |
| 5,097,454 | 3/1992 | Schwarz et al. | 109/8 X |

FOREIGN PATENT DOCUMENTS

| | | | |
|---|---|---|---|
| 2409364 | 7/1979 | France | 109/7 |
| 2735780 | 2/1979 | Germany | 109/2 |
| 3233843 | 1/1984 | Germany | 109/2 |
| 3337947 | 5/1985 | Germany | 109/2 |

*Primary Examiner*—Peter M. Cuomo
*Assistant Examiner*—Suzanne L. Dino
*Attorney, Agent, or Firm*—Alan Ruderman

[57] ABSTRACT

A security system including a security module positioned so that personnel traveling from a first zone to a second zone pass through the module for identification and verification of access. The module includes a card reader on one wall for reading an identification card inserted by the personnel, a scale for weighing personnel within the module, sensors for measuring the height, girth, position and direction of movement of personnel passing through the module, and video cameras for viewing such personnel. Information relating to whether the card is used properly, whether the card is correct and valid, whether issued to the person carrying the card and whether the person should be traveling between the zones at that time is determined and alerts provided when violations occur. The scale includes a floor plate suspended within the module. The sensors are infrared detectors connected within panels forming the interior walls of the module which are removably connected to the frame of the module by rods carried by the frame and selectively rotatable for receipt and locking within slots in brackets secured to the panels. Video cameras are concealed within end caps at the entry and exit ends of the wall on which the card reader is mounted and unobtrusively view personnel through one-way mirrors.

13 Claims, 15 Drawing Sheets

SECURITY MODULE

BACKGROUND OF THE INVENTION

This invention relates to a security module for identifying and verifying the identification of personnel accessing between stations in a facility such as an industrial complex and for signaling an alert when access is unauthorized.

The rise of terrorism, sabotage, industrial espionage and other acts of violence and theft and of other unauthorized entries to and at public and governmental facilities and industrial complexes has risen substantially in recent years. Security systems and security personnel are now commonplace at such installations. Verification of authorized access to such areas is thus significant if such acts are to be reduced or eliminated.

Security verification systems are known wherein an authorized individual is provided with an identification card which must be inserted within a card reader when accessing a secure area. Such cards may include a magnetic strip, bar code or laser read coded information and, if the card is authorized, the person carrying the card is permitted access without setting off an alarm or providing another alerting signal. Only those systems having a security officer to verify that a picture on the card corresponds to the person having the card are designed to verify that a valid card is being used by an authorized person. However, even where human error is not a factor and the carrier of an identification card corresponds to the person to whom the card was issued, there are circumstances when that person is not authorized entry to an area. For example, in facilities where aspects of an industrial process or the like should remain secret to all but a few authorized employees, other employees should be precluded entry. Although certain security officer protected systems provide cards that have a color or other visual code corresponding to the various restricted areas, tampering or other violations of such card may occur when unauthorized access to industrial or other secrets is the objective. Additionally, access to an area may be authorized to employees or others at certain times, but not at other times. For example, an employee working one shift may be permitted entry to an area during that shift but may be unauthorized to enter that area during other shifts or times.

SUMMARY OF THE INVENTION

Consequently, it is a primary object of the present invention to provide a system for identifying and verifying the identification of personnel accessing between stations or zones in a facility and for providing an alerting signal when the identity of a person entering or leaving a station or zone does not correspond to identifying data stored in the system.

It is another object of the present invention to provide a system including a security module through which personnel must pass when accessing from one area to another, the module having a card reader for reading data on an identification card entered into the reader by each person passing through the module, the module including means for measuring physical characteristics of each person passing through, and means for comparing the measured characteristics with prerecorded physical characteristics of the person to whom the card was issued.

It is a further object of the present invention to provide a security system including a module through which each person accessing a station passes in route to the station, the module including a card reader for reading identifying data on a card inserted into the reader by personnel entering the module, the module further including sensing means for determining the weight, height and girth of the person or persons within the module and the direction of travel of the person or persons through the module for validating or invalidating access between stations at that time.

It is a still further object of the present invention to provide a security module through which persons pass when accessing between stations or zones in a facility such as an industrial plant, the module having a floor supported for weighing persons passing through the module, the walls of the module having unobtrusive sensors for sensing the height, girth and direction of travel of such persons and having unobtrusive video cameras hidden at least at each end of the module for displaying visual images of persons within the module.

It is a yet further object of the present invention to provide a security module through which persons pass when accessing between areas or stations, the module having sensors embedded within wall panels of the module, the panels being attached to structural frame members by internal locking means including brackets on the internal surfaces of the panels having camming slots for receiving a locking rod selectively receivable within the slots and selectively precluded from extracting from the slots.

Accordingly, the present invention provides a security system including a security module which may be located between zones or stations within a facility and/or at the entrance to the facility so that personnel traveling between the zones and/or at the entrance to the facility must pass through the module, the module having a card reader for reading an identification card that must be inserted into the reader, and further including sensors for weighing personnel within the module, for measuring the height of such personnel, for measuring the girth and direction of movement of such personnel and video cameras for viewing those passing through the module. Information relating to whether the card reader is used properly, whether the card is correct, whether the card is valid, whether the card has been issued to the person possessing and inserting the card, and whether that person should be entering or leaving the zone at that time is determined and an alert is provided when there are violations or deviations. The alert may be a signal to security personnel for further immediate action and/or a recording of the violation/deviation for real time and subsequent auditing. Additionally if the card is verified for the person possessing the card and access is valid for that person information regarding physical characteristics of the personnel is recorded for updating the personnel file for that person. A plurality of modules may be mounted in various zones in a facility and networked into a central system where files are maintained and reports generated.

The module includes a floor suspended within the module by hangers extending within the walls and connected to a load cell so as to measure the weight of personnel passing through the module. Additionally, infrared sensing means which measure the height and girth of personnel within the module and the direction of passage through the module are embedded within the walls of the module so as to be hidden or unobtrusive, the inner panels of the module acting to hide the sensors from view. Video cameras activated by the ingress into and deactivated by egress out of the module by personnel are also mounted unobtrusively within the module and view the module occupants through one-way mirror elements. Thus, the card reader is the only visible intrusion of a personal identification device made within the module. The covert or clandestine intrusion provides the security system with a veil of secrecy that ensures its continuous effectiveness.

The module includes interior panels within which the infrared sensors are mounted and these panels are removably secured to the frame of the module by a unique system including brackets on the panels facing toward the frame, the brackets having a slot including a narrow channel opening onto a circular portion having a diameter larger than the width of the channel for receiving a rod rotatably carried by the frame. The rod has a diameter substantially equal to that of the circular portion of the slot and includes a plurality of reduced area flat sections corresponding to the number of brackets formed thereon so that the rod flat sections may be received through the channel of the respective bracket and into the circular portion. The rod may thereafter be rotated to lock the rod to the brackets and thereby the panel to the frame.

BRIEF DESCRIPTION OF THE DRAWINGS

The particular: features and advantages of the invention as well as other objects will become apparent from the following description taken in connection with the accompanying drawings in which.

DESCRIPTION OF THE PREFERRED EMBODIMENT

Figure 1:
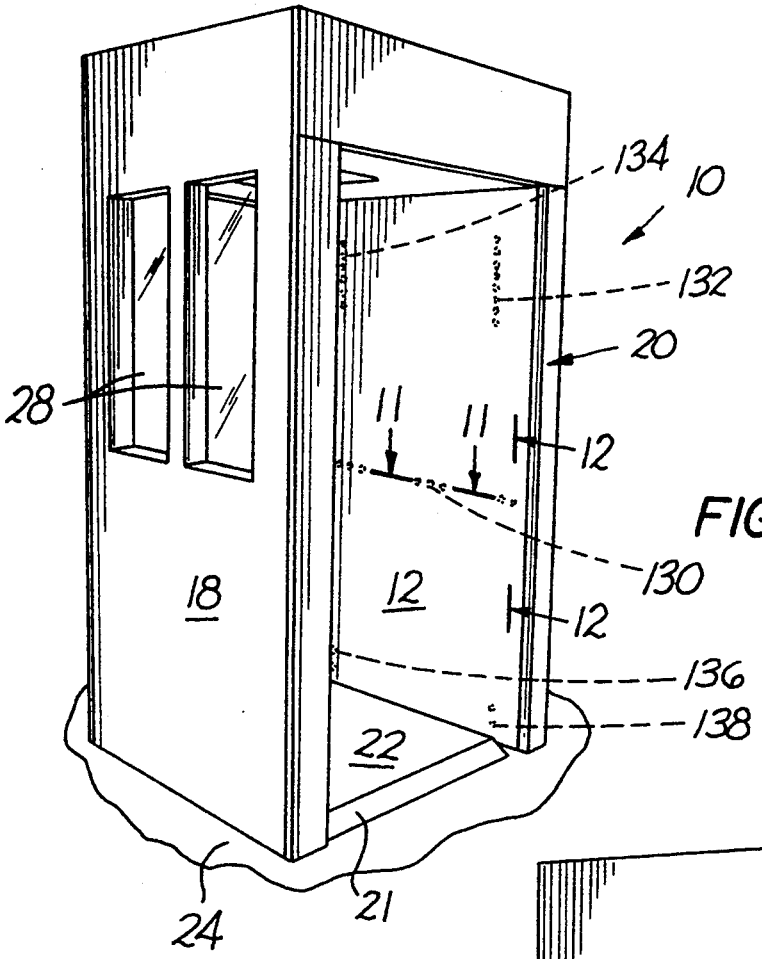
FIG. 1 is a perspective view of a security module constructed in accordance with the principles of the present invention illustrating one interior side.
Figure 2:
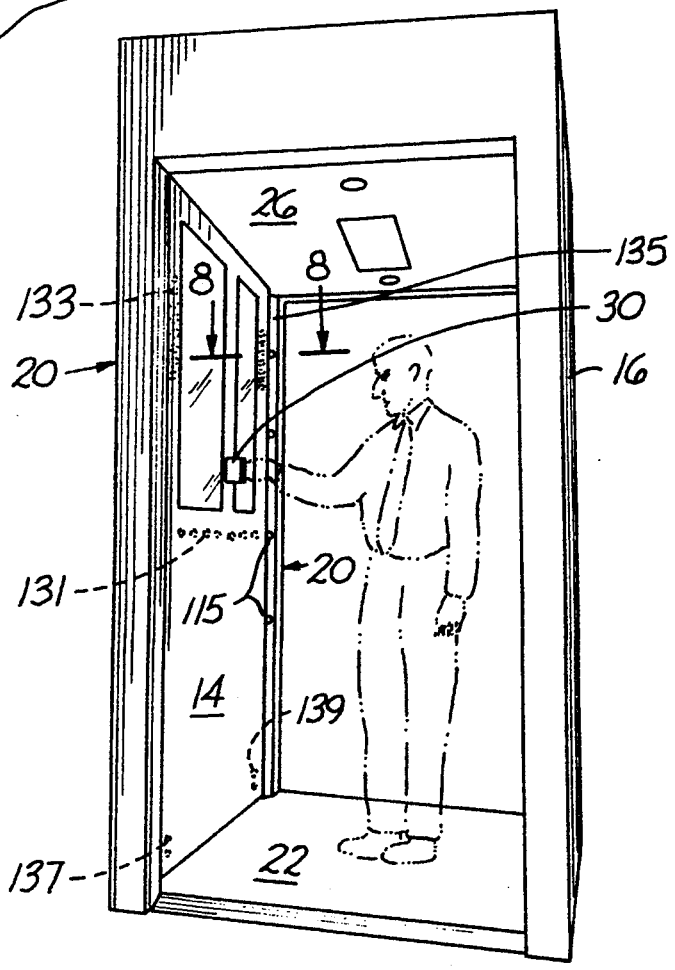
FIG. 2 is a view similar to FIG. 1 illustrating the opposite interior side.

Referring now to the drawings, FIGS. 1 and 2 illustrate a module 10 constructed in accordance with the principles of the present invention, there preferably being one such module at the entrance to each zone in a facility. For example, in an industrial plant there may be a module located at the entrance to the plant, and one at the entrance to distinct zones located throughout the plant where access to personnel may be restricted or controlled. Each module 10 may be a housing having sides including inner and outer side panels 12, 14, and 16, 18 respectively and open at each end for ingress and egress of personnel, the sides being connected to skeletal framework, hereinafter described with reference to FIGS. 3, 4 and 8, and to end caps 20 at the side of each end and to which further reference will be made. A floor 22 in the form of a plate having tapered ramps 21 of the required inclination is disposed wholly within the module so that the entrance to and exit from the module satisfies required governmental standards and permits the module to be placed against the walls adjacent existing doorways and the like, the floor 22 being suspended by approximately $\frac{1}{8}$ inch above the floor or ground surface 24 at the location of the module and forms part of a weighing system as hereinafter described. The module also includes a ceiling 26 above which various control elements and electrical wiring (not illustrated) may be mounted out of view from those entering and leaving the module. One side, namely that having the inner panel 14 and the outer panel 18 has a transparent portion such as windows 28 so that a security guard or the like may view the occupants in the module. That same side includes a card reader 30 mounted on the inner panel 14, the card reader being conventional and having scanning means for reading data or information on a conventional identification card issued to authorized personnel. The data or information on the card may be in any conventional form readable by the card reader, such as information applied to a magnetic strip or the like and such data may merely be a number corresponding to the person to whom the card is issued, such as an employee identification number.

Figure 3:
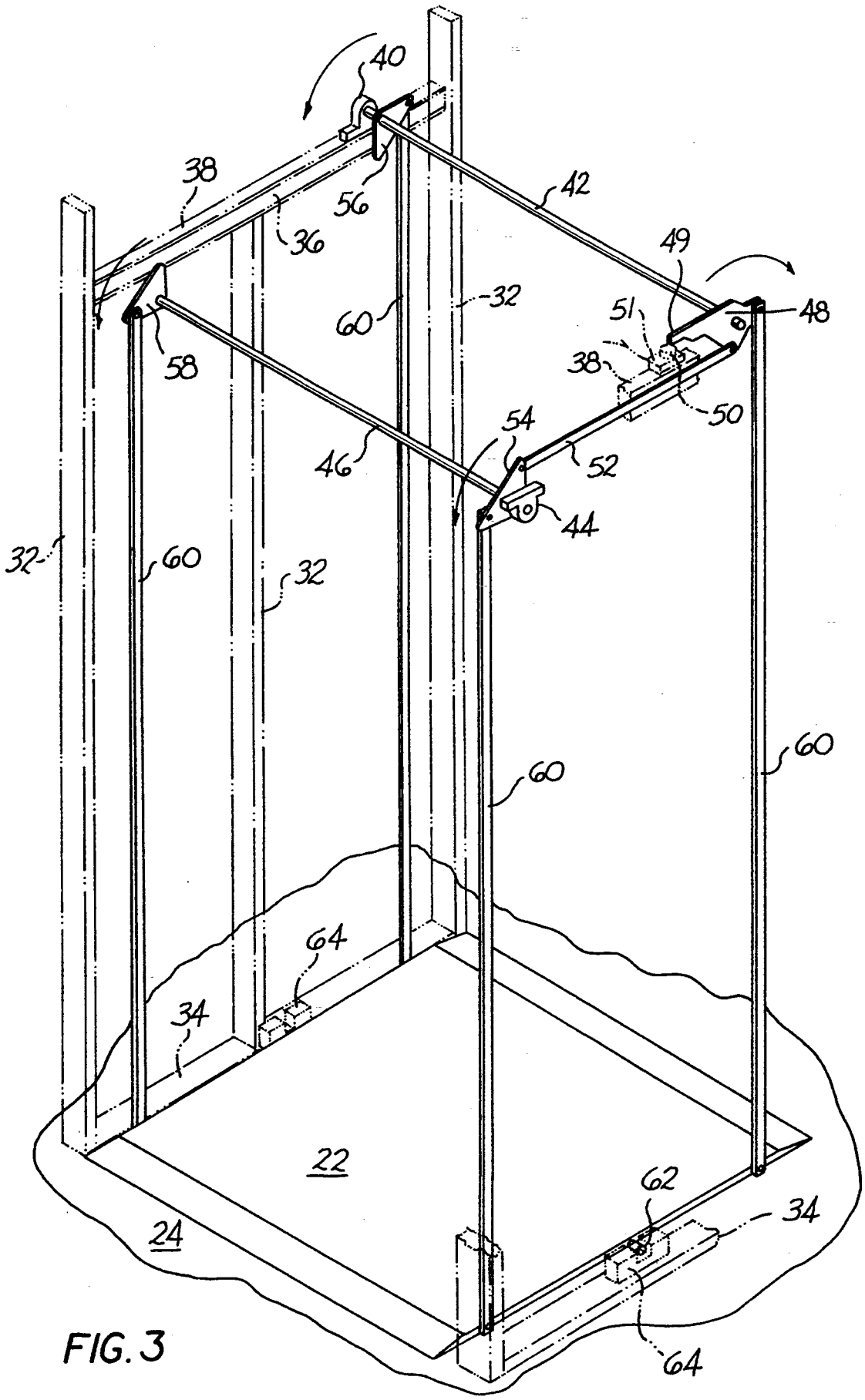
FIG. 3 is a perspective view of a portion of the skeletal framework of the module with parts thereof in phantom illustrating the construction of the weighing system in the module.

Referring to FIG. 3, the frame of the module includes a plurality of vertical upstanding wood struts such as those illustrated at 32, the studs at each side being secured to a respective horizontal base stud 34 spaced laterally from the floor plate 22 and to a respective header 36 spaced below the ceiling, each header being disposed within a channel beam 38 having a substantially C-shaped cross sectional configuration with an upper and lower flange. Secured to the upper flange of each channel beam 38 at one end of the module is a respective pillow bearing 40 (only one of which is illustrated) for journally receiving a first torque shaft 42 while a similar bearing 44 is secured to the lower flange of each beam 38 for journally receiving a second torque shaft 46. A torque plate 48 is fastened as by welding to one of the shafts, e.g., shaft 42 adjacent one end, the torque plate having an integral lever portion 49 positioned for abutting a conventional load cell 50 mounted on a metal block 51 welded to the top flange of the channel beam 38 at that side of the module. Pivotably mounted on the torque plate 48 is one end of a transfer arm 52, the other end of which is pivotably attached to a torque plate or arm 54 secured as by welding to the second torque arm 46 adjacent the end thereof. As illustrated, the transfer arm 52 is connected to the torque plates 48 and 54 in a manner such that rotation of the shaft 42 in a first direction effects rotation of the shaft 48 in the opposite direction. Other torque plates or arms 56, 58 are secured to the rods 42 and 46 respectively adjacent the ends remote from the respective torque plates 48, 54. If desired another transfer arm may connect the torque plates 56 and 58.

Pivotably connected to each torque plate 48, 54, 56, 58 is one end of a respective vertically extending hanger 60 in the form of a bar or rod, the other end of each hanger 60 is pivotably connected to a side edge of the floor plate 22 and suspends the floor plate above the floor 24 spaced from the base studs 34. Thus, whenever one or more persons are disposed on the floor plate 22 a load is applied to the hangers 60 and transferred by the torque arm 48 to the load cell 50. The weight on the floor may thus be determined by conventional calibration of the load cell. The mounting of the load cell by use of the torque shaft 42, 46 and transfer arm 52 ensures that the correct load corresponding to the weight on the floor plate 22 is transferred to the load cell irrespective of the location of the load on the floor plate. Thus, if the load is disposed closer toward one end than the other, the torque shaft 42 will rotate in the first direction resulting in the torque shaft 46 rotating in the opposite direction. The net effect is that the force applied to the load cell is substantially the same irrespective of the location of the load on the floor plate. To preclude the floor plate from swinging toward the ends of the module, a stud 62 is fastened to the floor plate at each side and is received within a narrow slot within a respective block 64 fastened to the base stud 34 at each side of the module.

As hereinafter described in detail each inner panel 12, 14 includes an array of signal generators for detecting when someone enters the module, together with that person or persons height, girth, direction of travel and position. These detectors are preferably of the infrared transmitting and receiving type wherein signals are sent by infrared energy from a transmitter to a receiver and the receiver retransmits the signals by hard wiring to logic circuitry. Preferably all the transmitters are in one inner panel while the corresponding receivers are in the other inner panel. The detectors are unobtrusively mounted within the panels so that those passing through the modules are unaware of detection.

Figure 4:
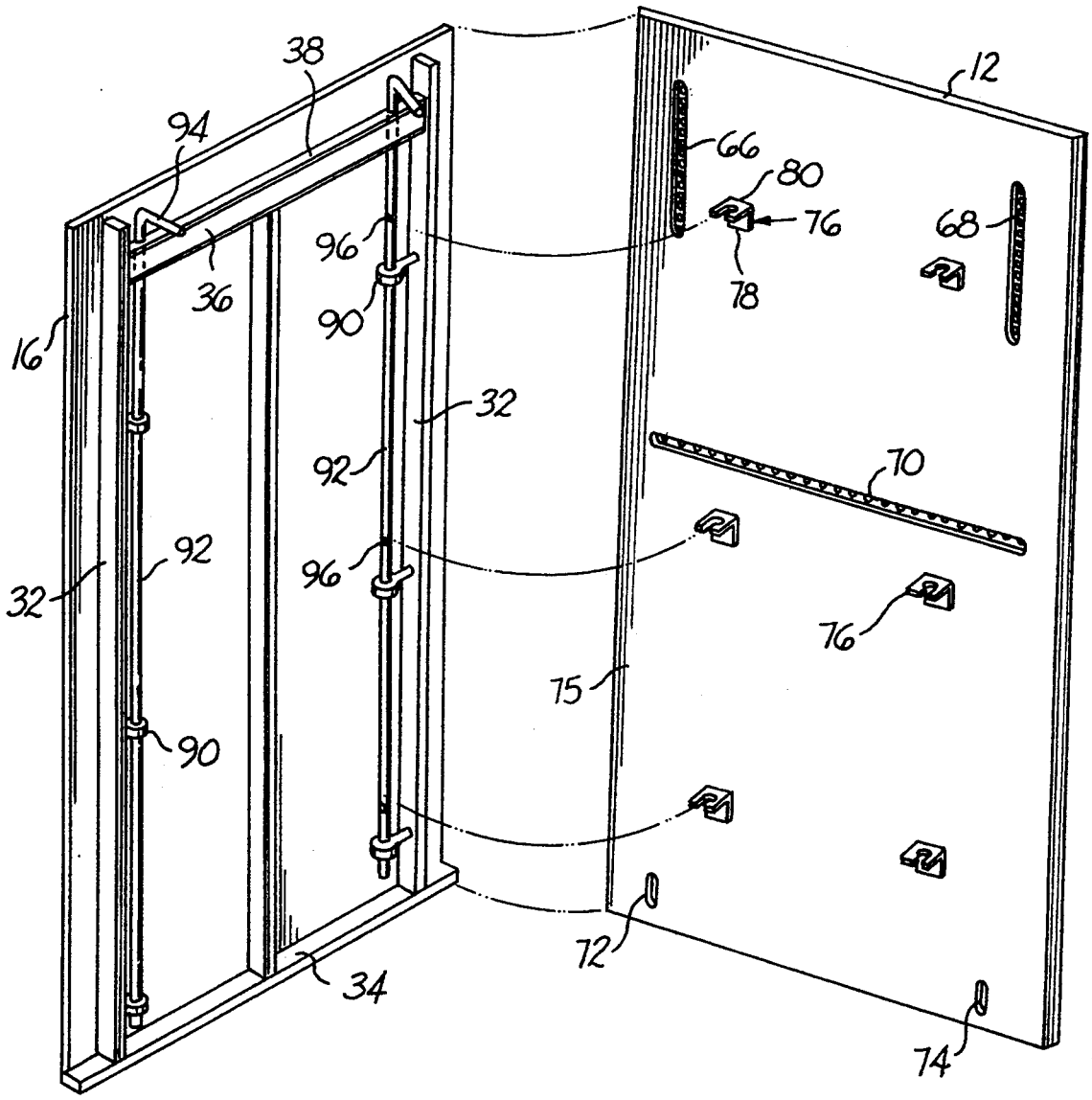
FIG. 4 is a perspective view illustrating the exterior facing surface of an interior panel of the module and the locking system in the wall for removably connecting the panel to the frame in accordance with the present invention.
Figure 5:
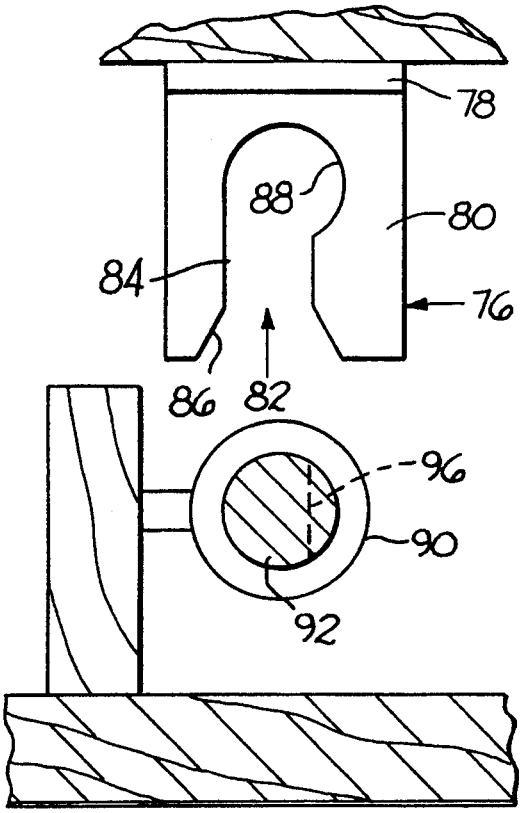
FIGS. 5 through 7 are diagrammatic views illustrating the manner in which the inner panels are connected to the frame.
Figure 6:
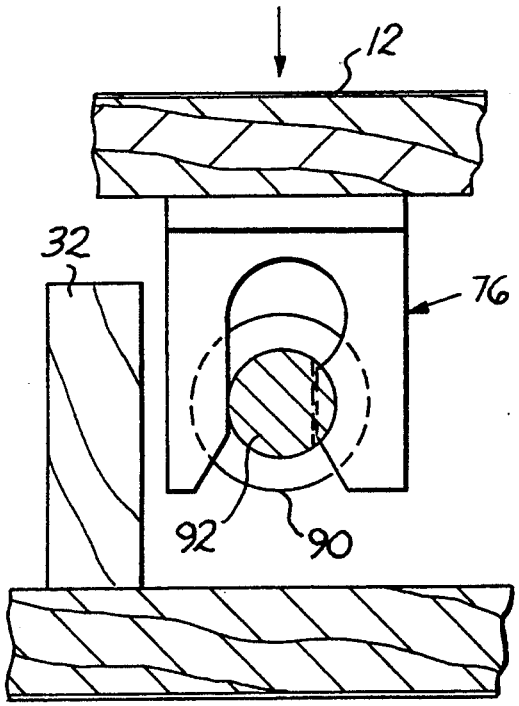
Figure 7:
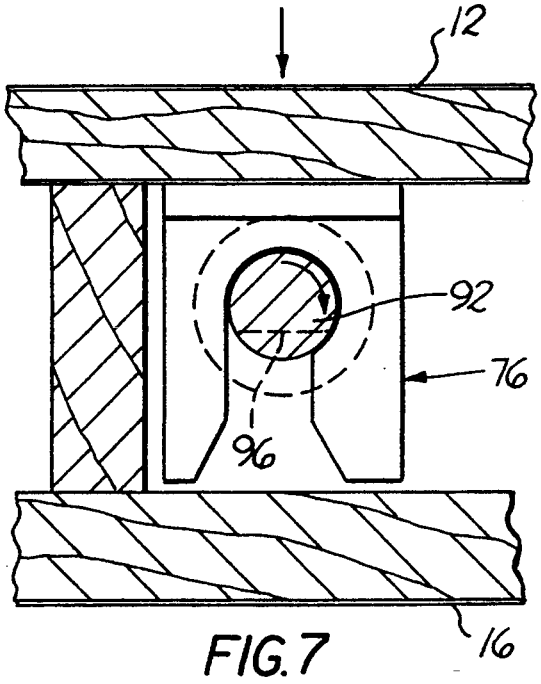

In order to mount the inner panels 12, 14 so that the detectors are readily wired to circuits within the ceiling of the module and for removal and remounting of the panels when maintenance or servicing of the detectors is performed, the present invention provides a panel fastening arrangement for releasably locking the inner panels to the frame. Thus, as illustrated in FIG. 4, in regard to the inner panel 12 which has detector circuit boards 66, 68, 70, 72, 74 mounted within and opening onto the externally facing surface 75 at predetermined locations, as hereinafter described, there are a plurality of vertically spaced attachment brackets 76, preferably in two or more horizontally spaced rows. Each bracket 76 has a substantially L-shaped form including a vertically disposed portion 78 which is secured to the exterior facing surface 75 of the panel, and a horizontally disposed portion 80. As best illustrated in FIGS. 5 through 7, the horizontal portion 80 has a slot 82 including a narrow channel 84 opening at a wide mouth 86 at the free end of the portion 80 and opening onto an arcuate portion 88 at the closed end. The arcuate portion 88 is of a partial circular form having a diameter larger than the width of the channel 84. As illustrated one edge of the channel may be substantially tangent and form a smooth transition with the partial circular form while the other edge abruptly intersects the partial circular form.

Secured to the end studs 32 are a plurality of collars 90, the collars having annular portions extending from stud attachment legs. The collars are arranged in vertically spaced apart disposition in two horizontally spaced apart vertical rows, the rows being spaced apart a distance substantially equal to the spacing between the channel slots 84 of the two bracket rows on the surfaces of the panels 12, 14. Journalled within the collars of a row is a respective locking shaft 92 which extends upwardly adjacent the channel beam 38 and includes a crank arm 94 at the upper end which may be used for turning the shaft, the diameter of the shafts 92 being substantially equal to the diameter of the circular portion 88 of the brackets. Each shaft has a reduced cross sectional area in the form of a flat surface 96 corresponding in number to the number of brackets 76 in a vertical row on the inner panel and disposed at a vertical disposition corresponding to each bracket in the respective row. The flat surfaces, which are ground on the rod, provide a spacing between the flat face and the remote peripheral surface of the shaft 92 such as to be received within the slot 82 of the respective brackets 76.

Thus, as illustrated in FIGS. 5 through 7, the inner panel and the shafts are positioned so that the flat surface of the shaft 92 may be received within the respective bracket slot 82 as illustrated in FIG. 5. The panel is then located and the shafts are then received within the slots as illustrated in FIG. 6. Thereafter the inner panels are pushed toward the outer panel and the crank 94 is turned to position the flats facing the slot entrance as illustrated in FIG. 7, thereby locking the inner panel to the frame. The outer panels carry no control or circuit elements and are thus merely fastened to the frames by conventional fastening means such as glue and screws, the outer panels preferably being melmine coated particle board.

Figure 8:
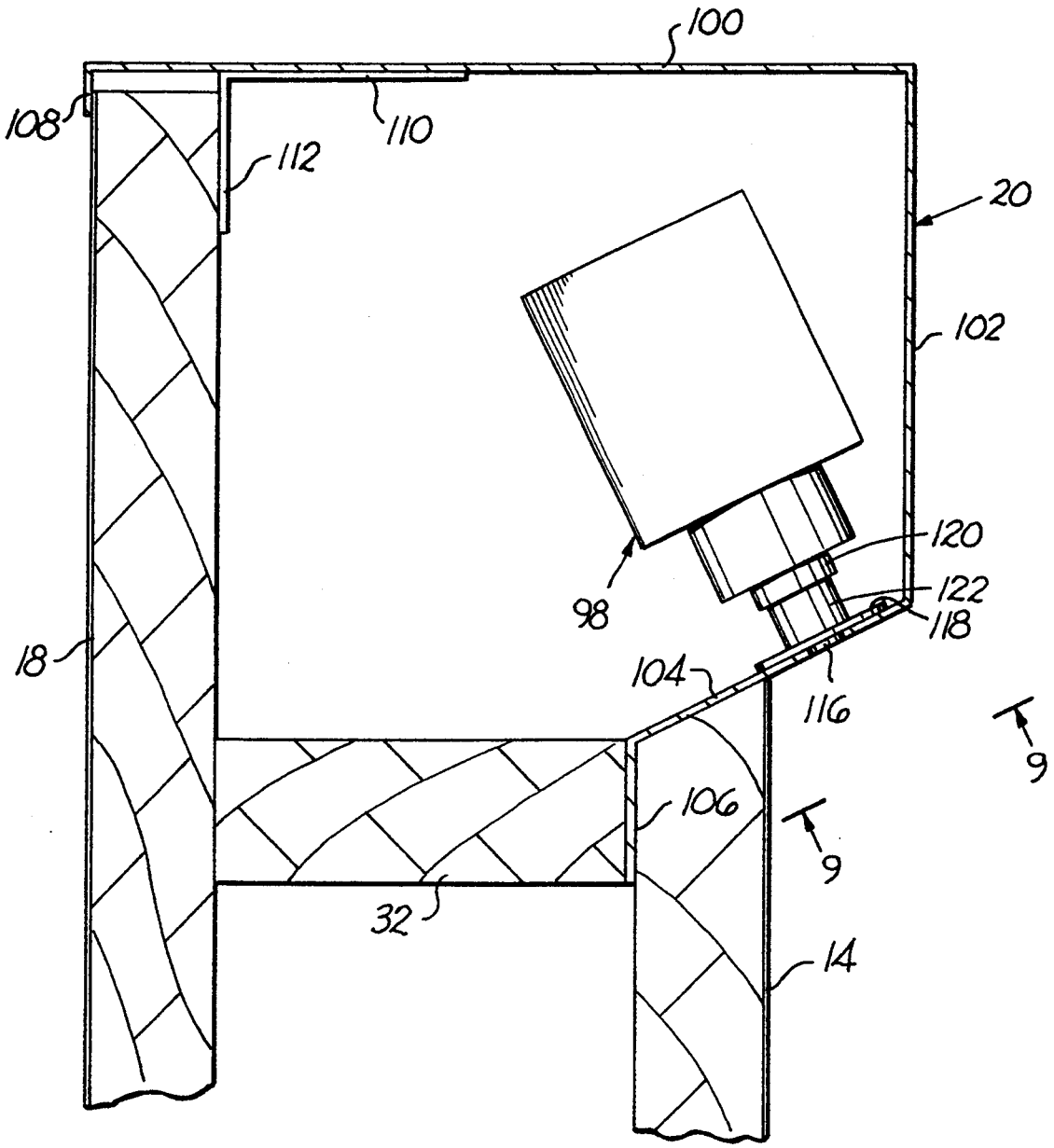
FIG. 8 is a cross sectional view taken substantially along line 8—8 of FIG. 2 illustrating the mounting of a video camera within an end cap at one end of the module.
Figure 9:
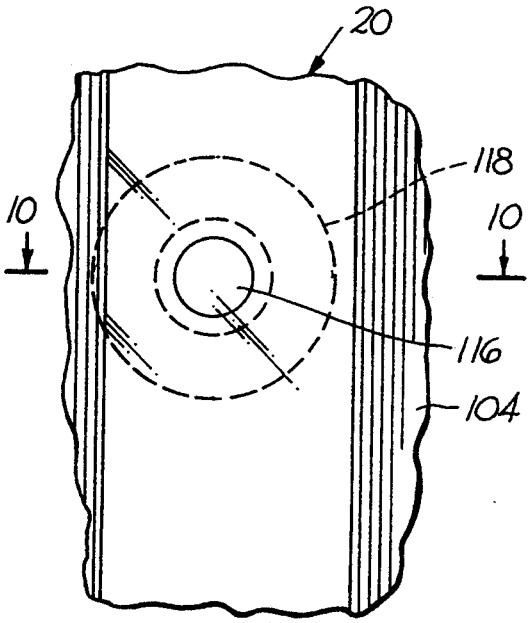
FIG. 9 is a fragmentary elevational view looking along line 9—9 of FIG. 8 illustrating a video capture port in the module.
Figure 10:
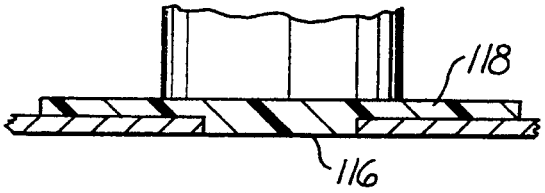
FIG. 10 is a horizontal cross sectional view taken substantially along line 10—10 of FIG. 9.

As aforesaid, the module 10 includes a video camera mounted unobtrusively therein, there preferably being one such camera 98 mounted in each end cap 20 at the side of the module on which the card reader is mounted and, although not illustrated, video cameras preferably are also mounted above the ceiling 26 of the module. As illustrated in FIG. 8, each end cap 20 is a vertically elongated integral rail having an end wall 100 facing outwardly from the end of the module, a first interior wall 102 disposed substantially normal to the wall 100 facing the interior of the module and the end cap at the opposite side of the module, and a second interior wall 104 inclined outwardly relative to the interior of the module and relative to the wall 102 preferably at an angle of approximately 120° so as to face toward the central portion of the module. Thus, the walls 104 of the two end caps at the card reader side of the module face the area where personnel are located when inserting or swiping the identification card in the card reader. The end caps also include a wall 106 bent relative to the wall 104 such as to be substantially parallel to the wall 102 and may include a narrow exterior wall portion 108 substantially parallel to the wall 102. The end caps, which preferably are polished stainless steel or other shiny metallic material, has one leg 110 of an angle beam welded or otherwise fastened to the interior of the wall 100 with the other leg 112 spaced from the wall portion 108. The wall 106 is secured to the respective end stud 32 while the outer panel 18 is sandwiched between the wall 108 and the leg 112, both preferably being by screws or the like (not illustrated) extending through respective holes in the wall and leg. The vertical edge of the inner wall panel 14 is tapered as illustrated in FIG. 8 and when mounted within the module as heretofore described abuts the walls 106 and 104 so that a neat aesthetic appearance is presented.

The walls 104 of the end caps 20 include a circular aperture 114 as illustrated in FIG. 2 behind which the video camera 98 is mounted. Disposed within the aperture 114 in each end cap on the card reader side is a small disk portion 116 of a larger disk 118 of acrylic one-way mirror material, the small portion 116 having a diameter substantially equal to that of the apertures 114. The larger disk 118 is cut away from one-way mirror material having a thickness equal to that of the larger disk plus the small disk and then the small central disk 116 is formed by cutting away the material between the peripheries of the large disk and the small disk. The face of the small disk 116 is coated with a film of chromium so as to blend in with the stainless steel of the end cap 20 and will not be readily apparent to one looking at the end caps. Radial portions of the larger disk may be glued to the inner surface of the end cap wall 104 with the small disk 116 disposed within the aperture 114. Similar disks may be inserted into other apertures 115 so that the aperture 114 through which the video camera views does not appear different and will not attract attention.

The video camera 98, which preferably is a solid state CCD camera, is mounted within the interior of the two aforementioned end caps behind the one-way mirror and includes a lens base 120 for mounting the lens (not illustrated) and a black plastic foam sleeve 122 is disposed about the lens, the sleeve acting to block exterior light and preventing light passing through the lens from being reflected away. Thus, the camera 98 unobtrusively views a portion of the interior of the module when activated, the lens being such that the head and upper body portion of one or more persons within the module may be viewed and recorded.

Figure 11:
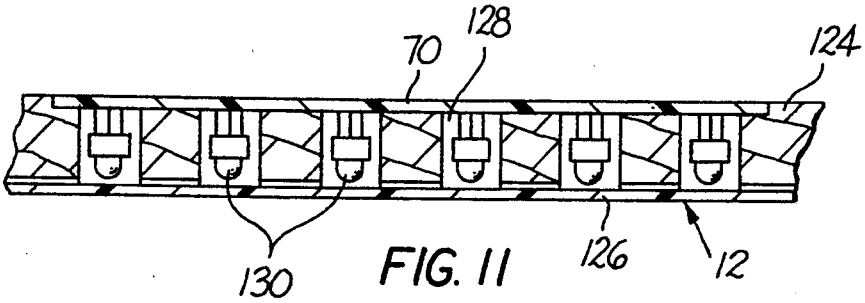
FIG. 11 is a horizontal cross sectional view taken substantially along line 11—11 of FIG. 1 through an interior panel wall of the module illustrating the mounting of the detectors or sensors within the panel.
Figure 12:
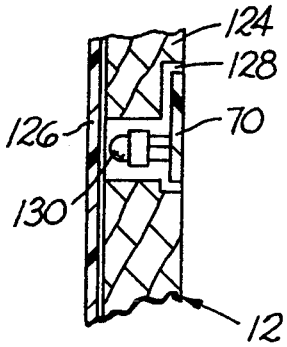
FIG. 12 is a vertical cross sectional view taken substantially along line 12—12 of FIG. 1 illustrating the mounting of the detectors within the panel.

As aforementioned the inner panels 12, 14 each include an array of infrared devices for sensing or detecting certain events and characteristics, the devices comprising infrared transmitters and receivers. The term detector or sensor is here defined as either a transmitter or receiver since both function together for detection purposes. Preferably all of the transmitters are carried by one of the panels, e.g., the panel 12 while the other panel, e.g., panel 14, carries all of the receivers. However, the mounting of the detectors be they transmitters or receivers is identical. Thus, for example, as illustrated in FIGS. 11 and 12 in regard to panel 12, the panels may be constructed from a combination of masonite and plywood 124 having an opaque sheet of material 126 on the surface facing the interior of the module, the material 126 being of a type that does not detract from the performance of the infrared detectors. It has been found that a sheet of 0.150 inch opaque high molecular weight polyethylene material performs ideally. Grooves 128 are routed in the plywood 124 for receiving the detector circuit boards, such as circuit boards 70, to which the detectors are electrically connected, and for receiving the detectors which are indicated by reference number 130 in FIGS. 11 and 12. For purposes of illustration and clarity of presentation the other detectors are merely illustrated generally in FIG. 1 by the hidden lines, the detectors 132, 134, 136 and 138 being respectively mounted in the circuit boards 66, 68, 72 and 74 while cooperating detectors are illustrated in FIG. 2 at 131, 133, 135, 137, 139.

The horizontally extending detectors 130, 131 determine the girth, position, direction of travel and number of persons entering the module, while the detectors 132, 133 and 134, 135 determine the height of those entering and leaving the module. The detectors 136, 137 and 138, 139, which are disposed approximately four inches above the floor plate 22, determine when the foot of a person enters the module, and since a person's foot generally precedes the person, these detectors at the entrance end will provide the first signals. Thus, when the signal transmitted by the transmitting detectors is not received by the corresponding receiving detectors, it is due to the presence of a person breaking the infrared energy beam. The height of those within the module may thus be sensed, as is the girth or width of the person, and thus the number of persons within the module may be determined. As the infrared beams are broken in seriatim, the direction of travel may be determined. When a first infrared beam is broken a video camera 98 begins recording, the particular camera being determined by the direction from which the person enters the module. The signals provided by these sensors, together with the weight determined by the load cell 50, as heretofore described, and the characteristic data patterns from the sensors and the load cell may be used by the system to determine if the person entering the module corresponds to the person to whom the identification card swiped through the reader was issued and is authorized to pass through the module from a first zone to a second zone.

Figure 13:
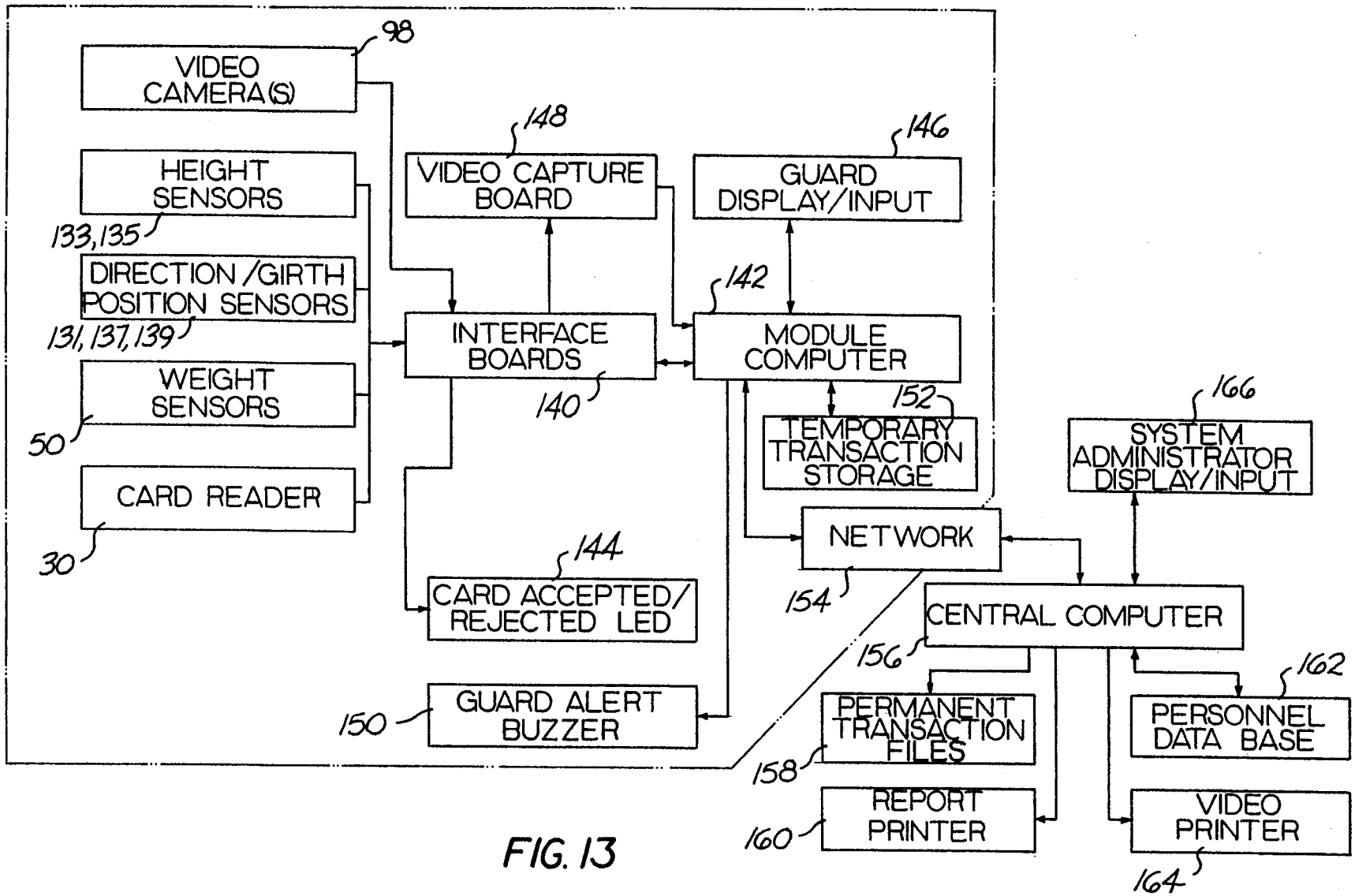
FIG. 13 is a functional block diagram of the components of the access verification system for the security modules of the present invention.

The overall identification and verification circuit for the security system may be readily understood by those skilled in the art by reference to FIG. 13 where a block diagram of the control for the security system is illustrated. Signals from the height sensor receivers 133 and 135, the direction/girth position sensors 131, 137, 139, the load cell 50, the card reader 30 and the activated video camera or cameras are fed to logic interface circuitry 140 preferably comprising two circuit boards. The first circuit board includes analog to digital (A/D) converting circuitry, camera switching circuitry for switching between cameras in the end caps 20 and ceiling in response to the direction of travel of personnel through the module and power circuits for powering and monitoring the sensors and the load cell 50. The second circuit board contains software drivers for interfacing the signals to software in a computer 142 associated with each respective module, the computer 142 preferably being a conventional personal computer including a central processing unit (CPU) such as the Intel Corporation 80286 or 80386 micro-computers, or if desired may be a more powerful system using a CPU such as an Intel 80486. The software program, which identifies and validates or invalidates a transaction in the module as hereinafter further described in detail, powers the interface board to drive identification card accepting circuitry 144 which either powers a card accept signal by illuminating a green light emitting diode (LED) or a card reject signal by illuminating a red LED which may be viewed on the card reader and a red line on a display/input 146 comprising a monitor and a keyboard used by security personnel at a remote location. It may be noted here that a transaction commences when a sensor or the load cell is activated and terminates when all sensors are deactivated.

The interface circuitry 140, which is on the bus with the computer, also transmits the video signals to a conventional video capture board 148 which is a circuit board within the computer which digitizes the video signals and transmits the digital signals to the computer 142 where it is stored in memory on a hard memory disk drive associated with the computer. The stored information becomes a historical record subsequently used as hereinafter described in the audit system viewed by a system administrator. The monitor of the display/input apparatus 146 shows every card reader transaction and provides information as to whether the card inserted into the card reader is or is not a correct card, whether or not the card has expired, whether the reader has been used during a transaction, whether or not the person and the identification card match, and whether or not that person should be at that location at that time. If the card is invalid or if anomalies or exceptions are noted, it is displayed on the monitor, the security personnel is alerted by an alert signal such as buzzer 150, and it is noted by the security personnel to the computer by use of the keyboard. The information from the computer regarding the transaction is temporarily stored in a buffer 152 on a hard disk drive controlled by the computer and moved when there is available transfer time through network system circuitry 154 such as ethernet network to a central computer 156.

The central computer 156, which may be a conventional personal computer having a CPU such as an Intel 80486 microcomputer chip receives such information from the various modules located in the different zones throughout the facility for both real time and/or historical auditing of the security system. The central computer 156 also transmits the data to various files and devices such as permanent transaction files 158, a report printer 160, the personnel data base 162, a video printer 164 and to the monitor of display/input apparatus 166 where a security system administrator may monitor the system and input exceptions for an exception report printed by the printer 160. The central computer 156 accesses the personnel data base 162 for receiving stored information regarding each individual inserting a valid card into the card reader. For example, an employee identification number in the information on the card corresponds to a particular employee and information relevant to that employee in the data base is accessed. Such information may be the shift to which the employee is currently assigned, and thus the times during which the employee may validly access zones or areas, the employee job code and the zones or areas of the facility in which the employee is permitted access, physical characteristics of the employee, whether that employee is currently on alert status for a prior breach or violation of security, and other information which may be used by the system. This information is transmitted from the central computer 156 through the network 154 to the module computer 142 for use in the system to verify access of the employee.

A transaction commences when a person enters a module. As the identification card is passed or swiped through the card reader a green light on the card reader illuminates to show that the system has accepted the card. The transaction is completed when the person has fully exited the module. A module transaction starts when any sensor is tripped, i.e., the load cell, card reader, position or height sensor. As the transaction starts, the module computer records the beginning time and date, collects weight signals at approximately 18 per second, records the patterns of sensors activated to determine direction of travel, height, girth, and position, all at approximately 18 receptions per second and any time two or more people are within a module. As a transaction starts, the module cameras output frames are selectively recorded, the software acting to direct which video frame or frames is to be digitized as part of the transaction. When the identification card is passed through the card reader, the software confirms that the card is read and, from its data base, that the card is valid, that the person is scheduled to be there at that time and date, and that the person has valid access to the area. If the answer to the above is "yes" the card reader LED will illuminate green. If the answer is "no" the LED on the card reader will light red and an alert is sent to the control monitor listing the denial reason or error. For example, if an employee is not scheduled to work at that time and date, the prompt will show time, date, identification number and show "employee not scheduled to work this shift." The transaction is also flagged for auditing as an exception by the system administrator. The ending time and date of the transaction is logged as a transaction is completed.

The module computer also processes the inputs from the card reader, sensors and load cell through a statistical neural network decision engine to compare the profile of the inputs, e.g., height, weight, girth, time, work area and job code, to the historical profile of the authorized card owner. From this comparison the software establishes a certainty factor that the present bearer of the card is the valid possessor of the card. If the certainty level is below a predetermined level established by the system administrator, the transaction is flagged as an exception for audit and the security control monitors are alerted. The central control computer receives and stores all module transaction data for real time and historical file purposes. Thus, the system administrator can view what is occurring at any module in the system at any time.

The central computer monitors relationships between all modules in the system in real time. Zones are established, monitored for logical relationships, e.g., passage can only take place between bordering zones, and outer zones are accessed before inner zones, etc., and reported in real time or historically. For instance, if modules are placed at every doorway in a building, all modules at exit doors can be used to provide a building perimeter zone and the units on inside doors may be arranged to provide an office zone, a production zone and a warehouse zone. The central computer may then monitor for valid transactions between zones and report exceptions. If, for example, an employee leaves a zone through which he or she did not enter through a module, the transaction is flagged as an exception. The central computer may also provide information such as how many employees are in a given zone at any point in time, or how many employees enter the building through one entrance versus another entrance. The audit functions of the system are performed through the central computer and the system administrator may review all transactions that have been flagged as exceptions as well as transactions that have a certainty level below a selected certainty level.

Figure 14:
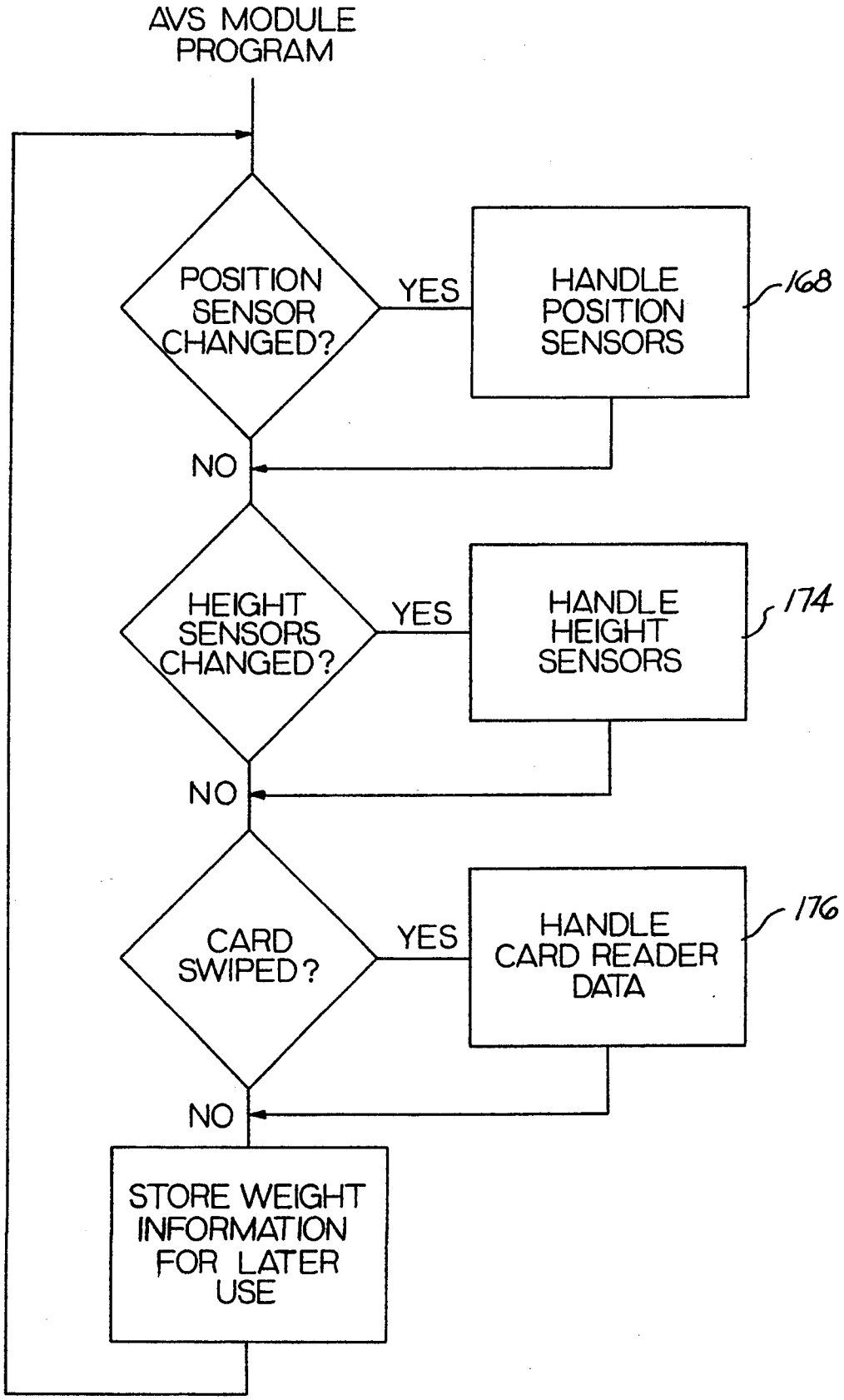
FIGS. 14 through 20 are flow diagrams illustrating the manner by which the system operates to verify the access of personnel through a module and to provide an alert signal and report when access is valid or an exception is found.
Figure 15:
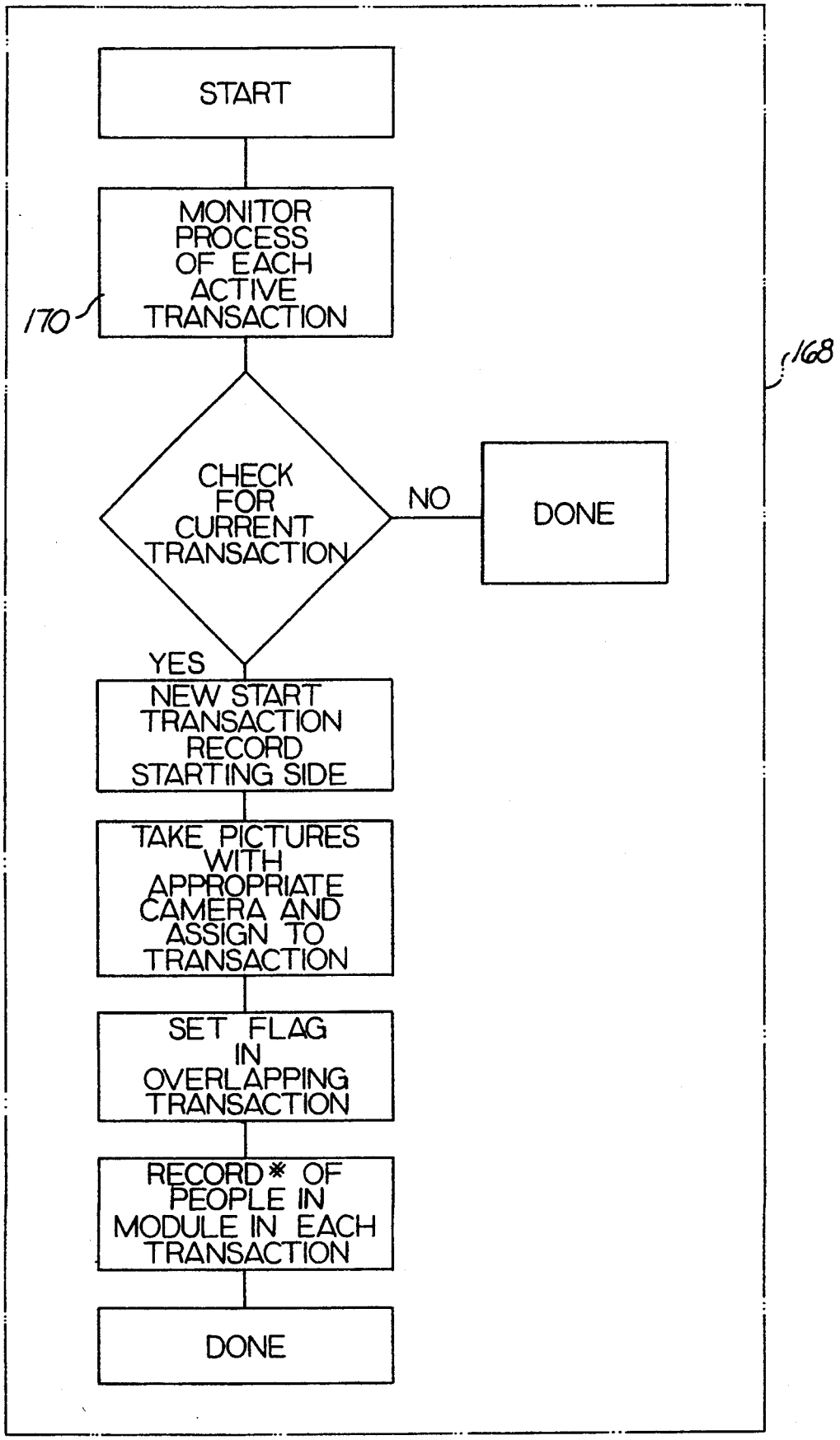

The computers 152 and 156 thus may be programmed in conventional manner to receive and process the information regarding each transaction in the respective module to identify whether the person with the identification card corresponds to information regarding that person and to determine whether the system is being breached so as to alert security personnel and effect an audit. Referring to FIG. 14, the program checks to see whether a position sensor has changed state, whether a height sensor has changed state, and whether the card reader was activated. Thus, when a person enters the module 10 a transaction commences normally either when that person's foot activates the receiving sensors 137 or 139 dependent upon the direction from which entry occurs or when the person steps on the floor panel and activates the load cell 50. The change in state of the sensors together with signals obtained when the person's identification card is inserted into the card reader results in enabling the program to treat or handle the signals and data. For example, when the state of a foot actuated receiving sensor 137 or 139 or a girth receiving sensor 131 is activated, the information from the position sensors is handled at 168 by the program according to the sequence illustrated in FIG. 15.

Figure 16:
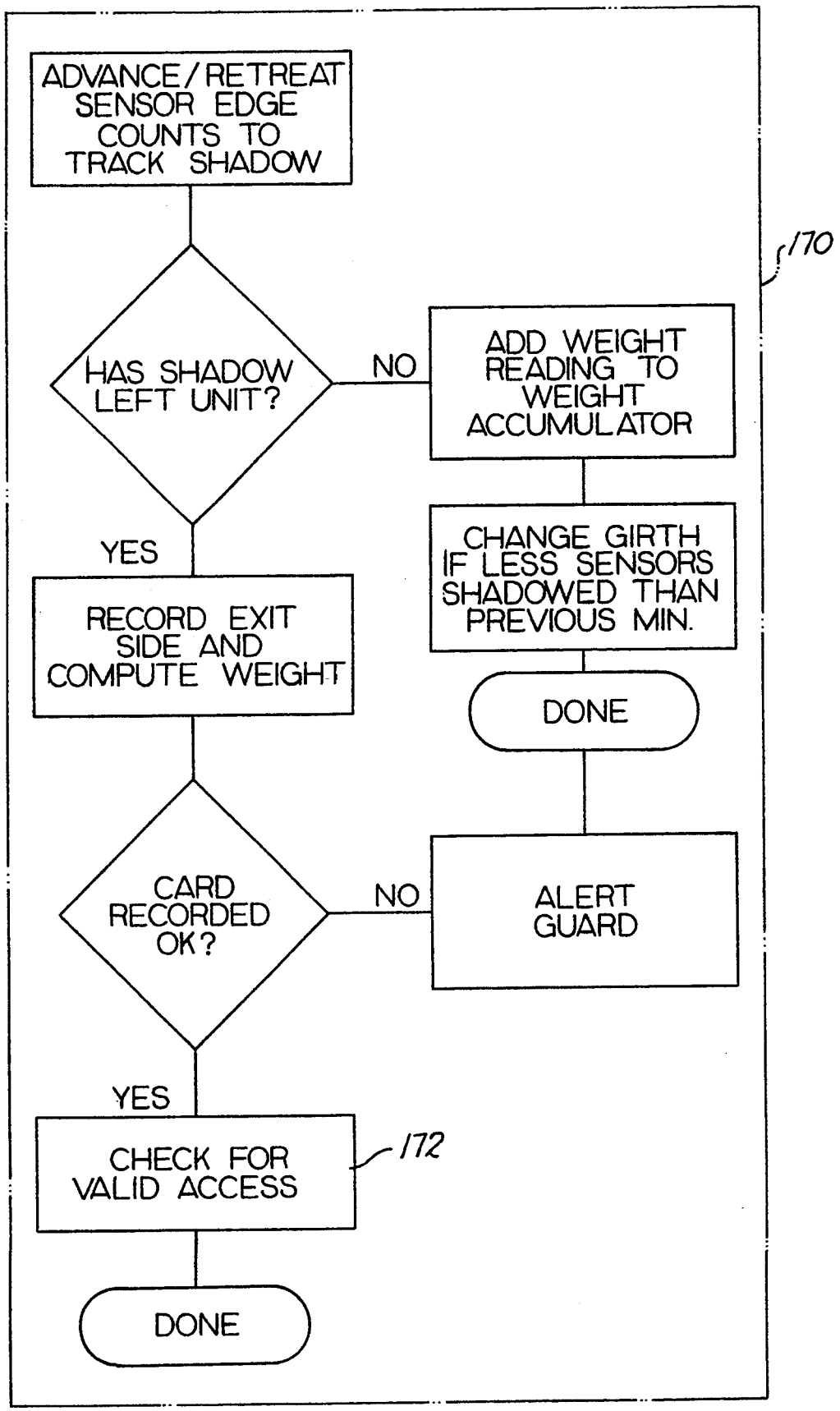

Progress of the transaction 170 is monitored in accordance with the program steps illustrated in FIG. 16. Thus, the shadow of the person within the module is tracked to calculate the girth value and weight value determined from the signals received and are transmitted to the central computer for updating these characteristics of the person within the module. The card reader is also checked to determine if the identification card has been read and, if not, an alert signal is provided to the display unit 146 and the alert signal buzzer or the like 150. If the card has been recorded the program checks, as indicated at 172, to determine if access for that person is valid as illustrated by the steps in FIG. 17 before or while completing the other program steps of FIG. 15.

Figure 17:
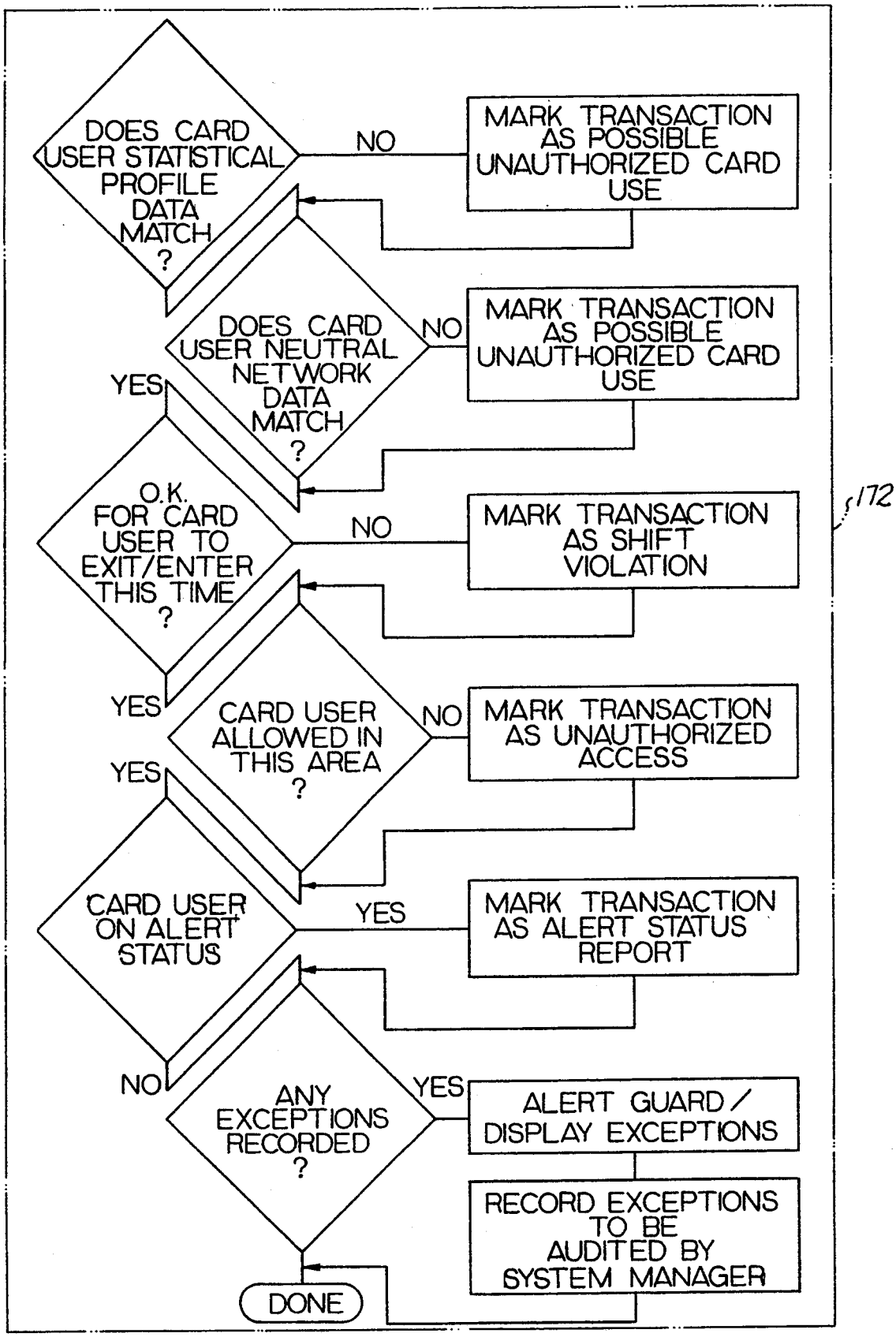
Figure 18:
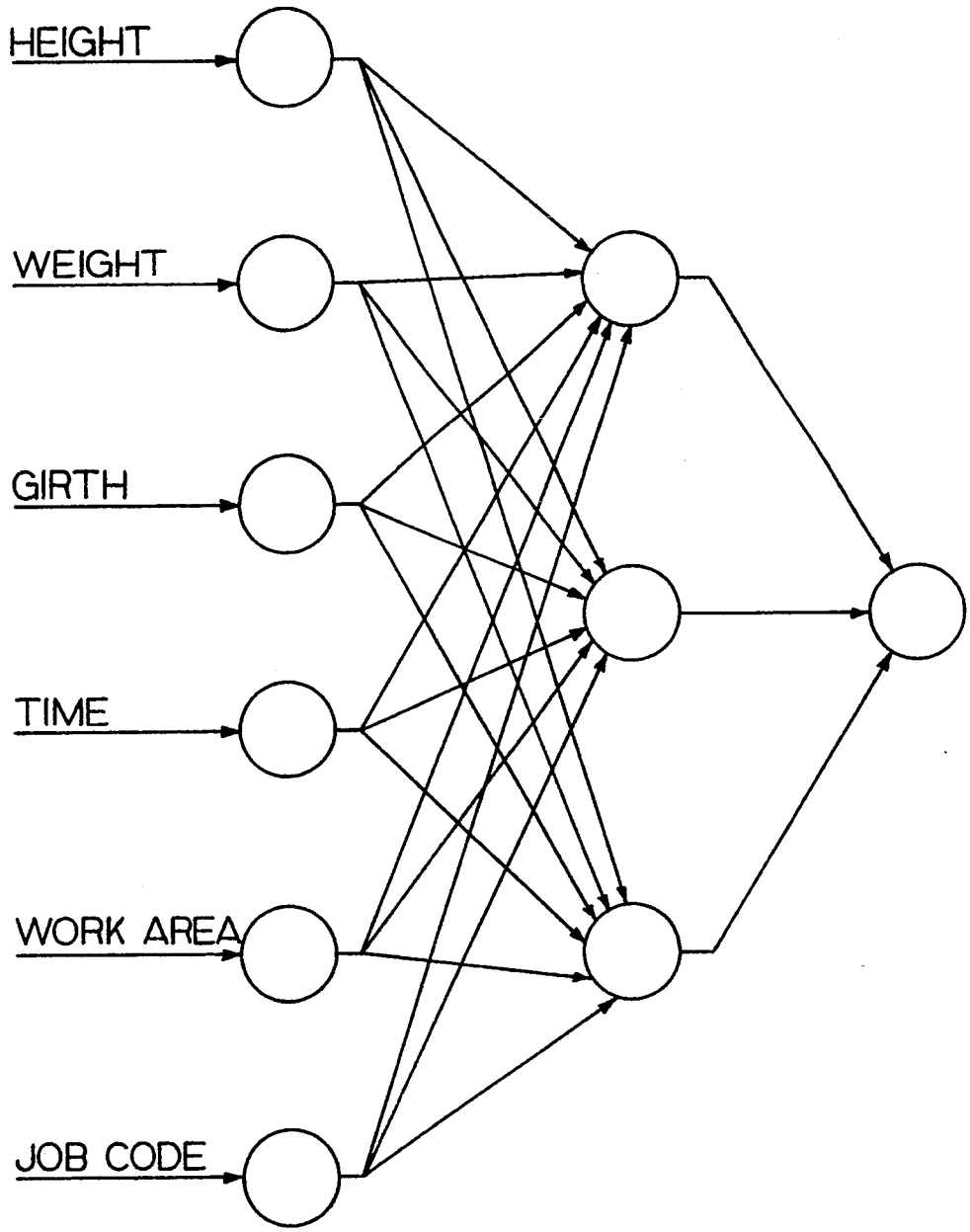

Thus, as illustrated in FIG. 17, the program compares the height, weight, girth and data patterns together with the access information of the person on the memory disk of the computers corresponding to the person to whom the identification card was issued so as to determine whether there is a data match or whether there may be an unauthorized use of the card. This is performed by a statistical decision engine and a backpropagation neural network, as illustrated in FIG. 18, in two stages. The first stage is a statistical stage wherein the data points are summed and averaged and the standard deviation from the card holder's historical averages is recorded as a transaction statistical certainty value. This statistical stage implements statistical models chosen by the system administrator. The second stage feeds the data points from the sensors into neural network neurons. The input layer of neurons, illustrated by the lower layer of neurons in FIG. 18, distributes the pattern of data points within this software construct. The middle layer, or computing neurons, act as feature detectors and react to characteristic features, i.e., validated card holder data patterns. The output layer of neurons generates a selected response. The weight of this response is compared to the target response and is recorded as a neural certainty value. Learning is achieved when audited transactions are confirmed or completed and when transactions are validated. These user inputs become learning weights subsequently used in the neural network. Transaction audits are optimized by conducting audits on all transactions with certainty values below a chosen confidence level. The reliability and accuracy of the system is documented by transaction audits and the certainty and efficiency are optimized by conducting audits on those transactions with the lowest statistical and neural certainty values as chosen by the system administrator for real time validation and historical audits. If the data does not match during the transaction, the transaction is marked as a possible unauthorized card use. If the card user is not authorized to enter or exit the area at that particular time, a shift violation is noted on the display unit 146. The same is true if the card user is not permitted entry into the area or if the card user is currently on alert status due to a prior violation. Any exception or anomalies that are determined to be presented are recorded and displayed on the unit 146.

The progress of the active transaction having been performed, the system further determines whether there is more than one person in the module and also starts the appropriate video camera or cameras to photograph the person or persons within the module. These and all other events occur substantially simultaneously during the program since a person may enter the module, swipe his or her card, and leave the module in a time frame of approximately a few seconds.

Figure 19:
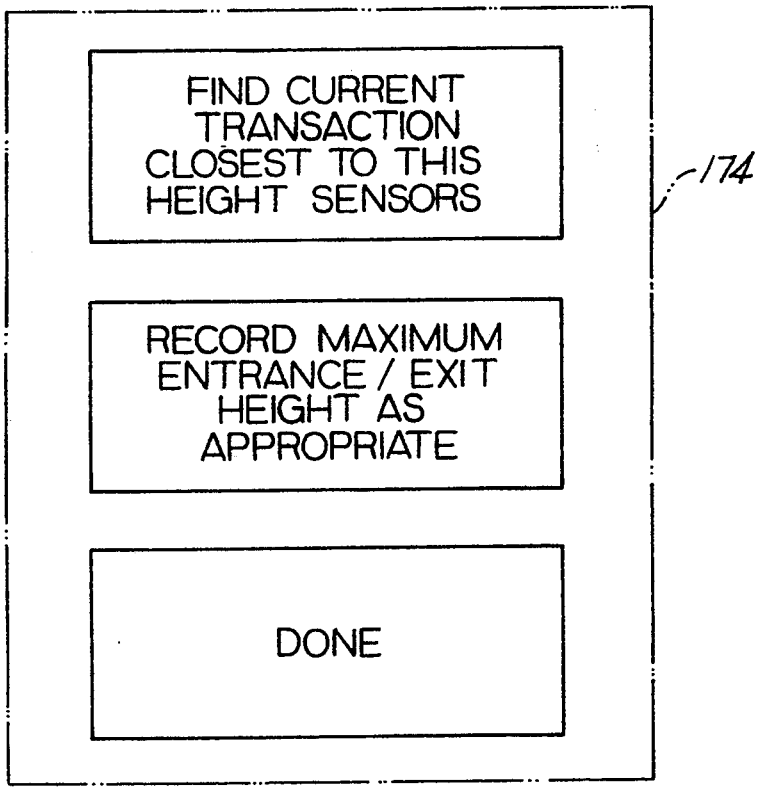
Figure 20:
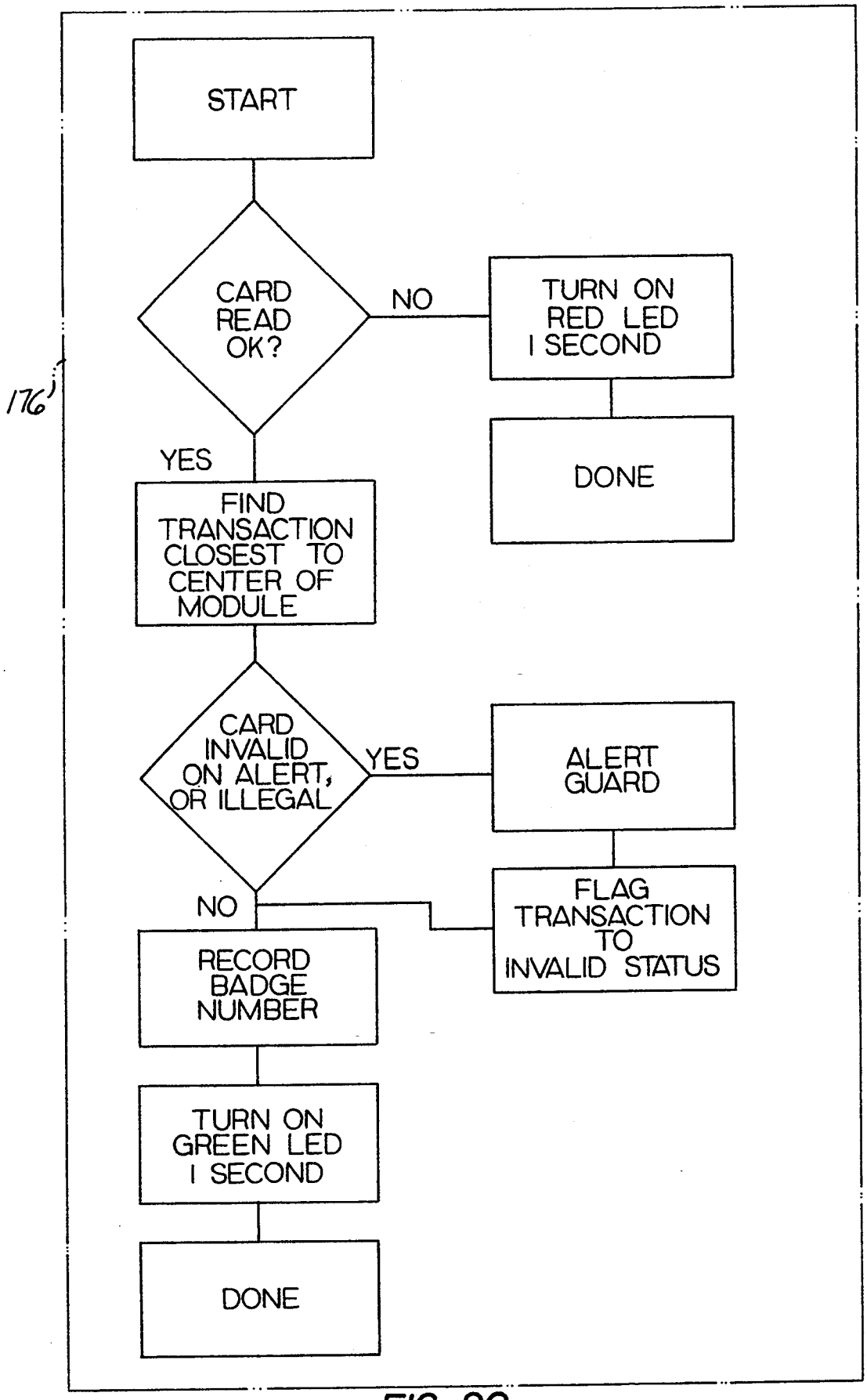

The information from the height sensors is handled at 174 illustrated in FIGS. 14 and 19. The data for a transaction corresponding to the height sensor is correlated so that the correct height of a person when there is more than one person within the module can be utilized in the statistical and neural network, and the maximum height is recorded. The card reader data is handled at 176 as illustrated in FIGS. 14 and 20. As aforesaid, if the card is an incorrect card or if for some reason the information is improperly read, the read light at the card reader 30 is illuminated and a red line or band appears on the display 146. If the card is read the transaction corresponding to the data read at the center of the module is utilized to determine if the card is a valid and legal card and if the card holder corresponding to a valid card is on alert status. A legal and valid card held by one not on alert activates the green LED at the card reader otherwise the guard is alerted and the transaction is flagged for audit.

Figure 21:
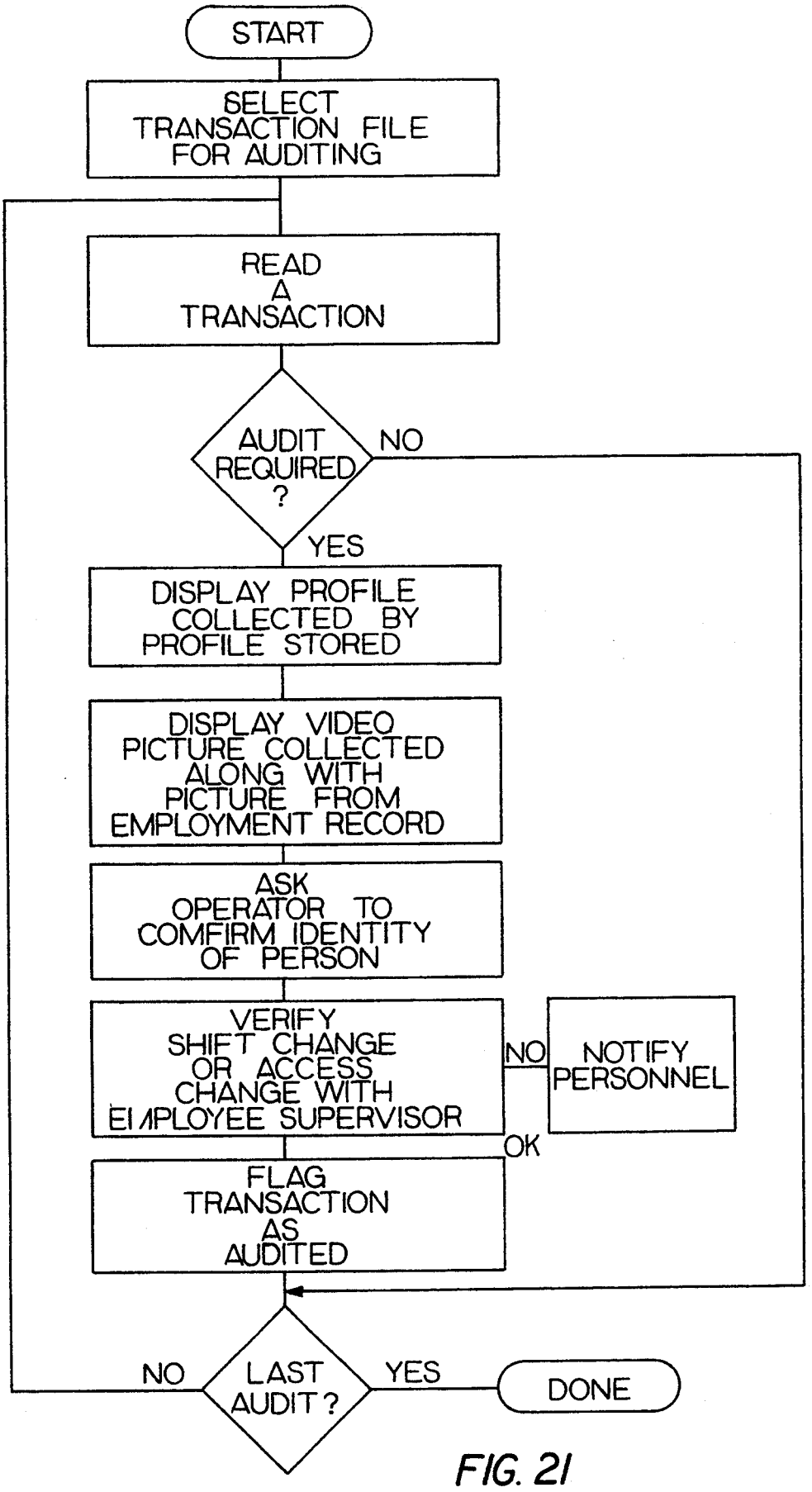
FIG. 21 is a flow diagram illustrating the manner in which sojourns through the modules are audited.

Auditing of the transaction file both for real time and historic purposes is illustrated in FIG. 21. When an audit has been flagged the stored information including the video picture is displayed through a graphical replay of the transaction and compared with the information from the personnel data base for verification of the identity of the person involved in the transaction.

Accordingly, the present invention provides a system including walk-through modules containing a card reader, floor scale, CCD video cameras and position/-height sensors which are interpreted to derive height, girth, weight passage of multiple people, direction of travel and digitized images from different perspectives in each passage. Each module includes its own computer, hardware drivers and software so that it may process the basic inputs and develop a discreet transaction and various outputs. The modules function in a network environment such that each module operates independently for each passage, i.e., transaction, yet each module may compare the data obtained in each transaction to an historical profile of each user that is distributed to each module on the network by a central control computer. Each individual module passes each transaction record to the central computer for real time system-wide control and data storage.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A security module located between two zones for aiding in identifying and verifying the access of identification card carrying personnel passing therethrough while traveling between said first and second zones, said module comprising a housing having a pair of spaced apart side walls including interior wall surfaces extending between an entry end and an exit end, a floor plate disposed within said housing intermediate said walls and upon which personnel must step during passage through said module, a card reader on the interior wall surface of one of said walls for receiving said card and reading identification data on said card identifying a person to whom the card was issued and generating a signal in response to said data, personnel sensing means mounted within said walls in a horizontal and a vertical array for generating signals in response to the presence and absence of personnel at different horizontal and vertical locations within said module, weight responsive means including said floor plate for generating signals corresponding to the amount of weight on said floor plate, means for receiving the signals from said card reader, said personnel sensing means and said weight responsive means for determining the height, girth and weight of a person within said module and for determining a compatibility of each with identifying data corresponding to the person to whom the card was issued, and means for generating an alerting signal when compatibility is lacking.

2. A security module as recited in claim 1, including means for mounting a video camera in each end of said one wall disposed for viewing a person proximate said card reader, control means responsive to said signals from said personnel sensing means indicative of the presence of a person within said module for activating the camera remote from the end from which the person entered said module for viewing and obtaining images of said person within said module, and means for receiving and storing said images.

3. A security module as recited in claim 1, wherein said personnel sensing means are disposed in a first vertical array adjacent one end of said module and a second vertical array spaced from said first vertical array at the other end of said module for generating signals indicative of the height of personnel entering and leaving said module, and said personnel sensing means are disposed in a horizontal array extending from adjacent one end of said module to adjacent the other end of said module for generating signals indicative of the girth and position of personnel within said module.

4. A security module as recited in claim 3, wherein said personnel sensing means comprises infrared transmitting means mounted in a first of said walls and infrared receiving means mounted in the other of said walls.

5. A method for controlling the access of personnel from a first zone to a second zone within a facility, said method comprising:

(a) positioning a module intermediate said first and second zone;

(b) providing a data bearing identification card to each person permitted access to said first and second zones;

(c) storing data corresponding to the weight, height and girth of each person to whom an identification card was issued;

(d) reading the data on the identification card of each person traveling through said module while said person is within said module to determine the identity of the person to whom the card was issued;

(e) weighing each person traveling from one of said zones to the other of said zones while within said module;

(f) determining the height of each person traveling from one of said zones to the other of said zones while within said module;

(g) determining the girth of each person traveling from one of said zones to the other of said zones while within said module;

(h) comparing the weight, height and girth of each person within said module with the stored data of the weight, height and girth of the person to whom said identification card was issued to determine compatibility therebetween; and (i) generating an alerting signal when the compatibility is not presented.

6. In the method as recited in claim 5, including positioning a video camera within said module for viewing each person entering from said first zone and a video camera for viewing each person entering from said second zone; determining the zone from which each person enters said module; and activating the video camera positioned for viewing entry of a person into said module from the zone from which said person entered into said module.

7. A security module disposed on a floor surface and through which personnel must pass when traveling between zones at opposite ends of said module such that said personnel may be weighed within the module, said module having a frame positioned on said floor surface, a pair of spaced apart interior facing side walls within said module supported by said frame extending between entrance and exit ends of said module, a floor plate within said module disposed for stepping upon by personnel when passing through said module, a plurality of elongated rigid hangers pivotably connected to said floor plate at spaced apart locations adjacent each wall, an arm pivotably connected to each hanger at a location spaced above said floor plate adjacent a respective wall, means for rotatably mounting said arms on said frame for rotation of said arms in directions responsive to the weight on said floor plate, and a load cell fastened to said frame above said floor plate and disposed for abutment by one of the arms for generating a signal responsive to the abutment force applied by said one arm.

8. A security module as recited in claim 7, wherein said means for rotatably mounting said arms comprises means for connecting each arm adjacent one wall to an arm adjacent the other wall for rotation in the same direction, and transfer means for connecting the arms adjacent each wall for rotation in opposite directions.

9. A security module as recited in claim 8, wherein a hanger is disposed adjacent each end at each side, each hanger being disposed within a respective side wall remote from the opposite side wall.

10. A security module as recited in claim 8, wherein said means for connecting each arm adjacent one wall to an arm adjacent the other wall comprises a shaft journalled for rotation relative to said frame.

11. A security module as recited in claim 8, including means for precluding movement of said floor plate in the direction of said ends.

12. A security module as recited in claim 11, wherein a hanger is disposed adjacent each end at each side, each hanger being disposed within a respective side wall remote from the opposite side wall.

13. A security module as recited in claim 12, wherein said means for connecting each arm adjacent one wall to an arm adjacent the other wall comprises a shaft journalled for rotation relative to said frame.

* * * * *